US005470178A

United States Patent [19]

Weholt

[11] Patent Number: 5,470,178

[45] Date of Patent: Nov. 28, 1995

[54] INSULATING TUNNEL LINER SYSTEM

[76] Inventor: Raymond L. Weholt, 3119 W. Commodore Way, #1A, Seattle, Wash. 98199

[21] Appl. No.: 197,937

[22] Filed: Feb. 17, 1994

[51] Int. Cl.[6] ..... E21D 11/00

[52] U.S. Cl. ..... 405/152; 405/150.1; 405/151

[58] Field of Search ..... 405/151, 152, 405/153, 150.1, 124, 125, 132, 134, 135; 52/506.02, 506.03, 506.04

[56] References Cited

U.S. PATENT DOCUMENTS

| | | | |
|---|---|---|---|
| 3,783,625 | 1/1974 | Gantke et al. | 405/152 |
| 4,730,427 | 3/1988 | Tomsin | 405/151 |
| 4,940,360 | 7/1990 | Weholt | 405/151 |
| 5,046,893 | 9/1991 | Borgnini | 405/151 |

FOREIGN PATENT DOCUMENTS

| | | | |
|---|---|---|---|
| 926255 | 4/1955 | Germany | 405/151 |

*Primary Examiner*—Dennis L. Taylor
*Attorney, Agent, or Firm*—Richardson & Folise

[57] ABSTRACT

An insulating liner system especially adapted to railroad and highway tunnels to eliminate ice buildup on the tunnel crown, walls and roadbed caused by water leakage from the tunnel face. The insulating liner system includes a modular assembly of insulating panels, each comprised of a sheet metal or plastic face adherred to a preformed insulating foam core which is then waterproofed by coating all exposed faces of said core with an elastomeric or similar waterproof film. The ability of both the foam core and the elastomeric coating to stretch allows the panels to be fabricated and shipped in a flat configuration and formed to the tunnel arch during installation. The system also includes an insulating base with enclosed water drainage system, means of joining individual panels with waterproof joints, methods of supporting the liner system to the tunnel walls and a means of equalizing piston-effect pressures on the front and back faces of the liner system.

9 Claims, 5 Drawing Sheets

INSULATING TUNNEL LINER SYSTEM

BACKGROUND OF THE INVENTION

This invention relates generally to an insulating liner system for railroad and highway tunnels to eliminate ice buildup on the tunnel crown, walls and roadbed caused by freezing of water leakage from the tunnel face. The invention disclosed herein is a modification of my U.S. Pat. No. 4,940,360 which was designed for high flexural strength and section modulus to withstand minor rockfall on exposed rock face tunnels and to accommodate filling of the annular space between the rock face and the liner system with a lightweight concrete material to preclude future rockfall.

The present invention is designed for application on wet concrete-faced tunnels where high-strength is not a requirement. By substituting an elastomeric coating on the back face of the insulating core for the sheet metal back face of the original panel, the panels can be fabricated flat and formed to the tunnel configuration during installation thus substantially reducing the cost of fabrication and installation.

SUMMARY OF THE INVENTION

The panel system defined herein consists of a modular assembly of insulating panels, each comprised of a sheet metal face adhered to a preformed insulating foam backing which has been totally enclosed by an elastomeric coating or similar water and vapor barrier film. The ability of both the foam and the elastomeric coating to stretch allows the panel to be fabricated flat and formed to the tunnel configuration during installation. Individual panels are joined to adjacent panels by means of butt joints, waterproofed with a non-hardening, compatible sealant, and secured by sheet metal screws through a lap joint flange at the front face of the panel.

The preferred mounting of the liner system to irregular concrete tunnel walls consists of through-panel nylon or similar low thermal-conductivity mounting bolts secured to longitudinal angles or channels which in turn are mounted to the concrete tunnel face with anchor rods. In those instances where the tunnel walls have been formed and poured to reasonable tolerances, the support framing system defined above can be replaced by a low-durometer disc attached to the panel at through-bolt penetration points, such disc to serve as a spacer between the panels and tunnel face and an equalizer to accomodate minor irregularities of the tunnel face. In such a case, the through-bolt is attached directly to the tunnel wall by means of wedge anchors or similar anchoring method.

A footing for the panel system is provided consisting of a field formed and poured mixture of chemically-hardening binder and insulating aggregate to form a structurally sound, insulating base. A drainage system is incorporated in the base to remove water from the annular space between the panel system and the tunnel walls.

The resulting installation provides for a liner system which maximizes tunnel clearance, is waterproof and, by virtue of the fire-resistant foam and interior metal skin, is non-combustible. The low thermal conductivity of the liner system serves to insulate the concrete tunnel face from freezing, allowing water flow to be redirected to the drainage system at the liner base. The modular construction of the liner system provides for rapid field installation, thus minimizing remote-area labor costs and accommodating live-traffic conditions during construction. The ability of the panels to be formed to the configuration of the tunnel during installation eliminates the requirement to preform the tunnel arches during manufacture, thus minimizing manufacturing and shipping costs.

DESCRIPTION OF THE PREFERRED EMBODIMENT

Figure 1:
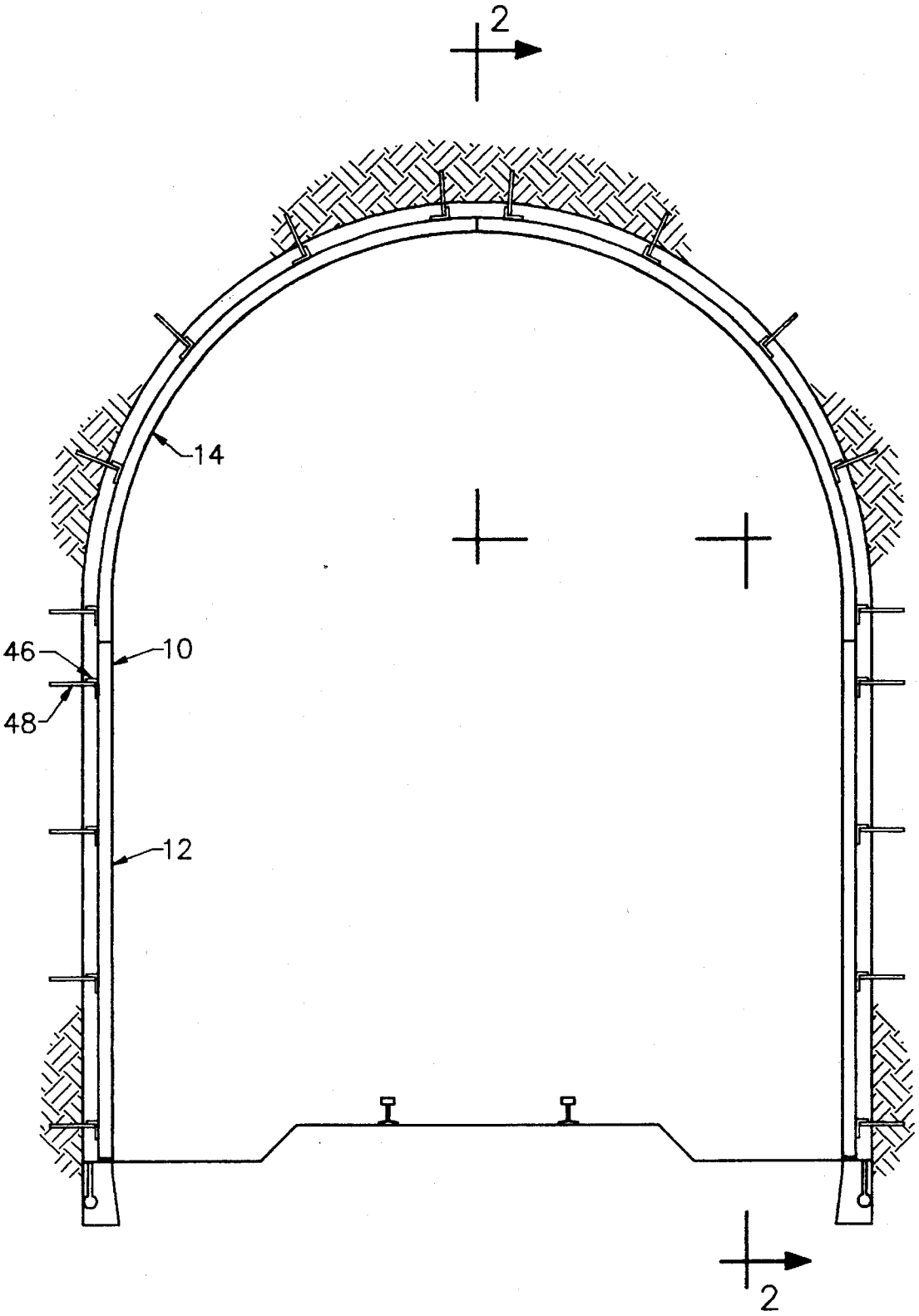
FIG. 1 is a typical transverse sectional view of a tunnel which incorporates the insulating tunnel liner of this invention.
Figure 2:
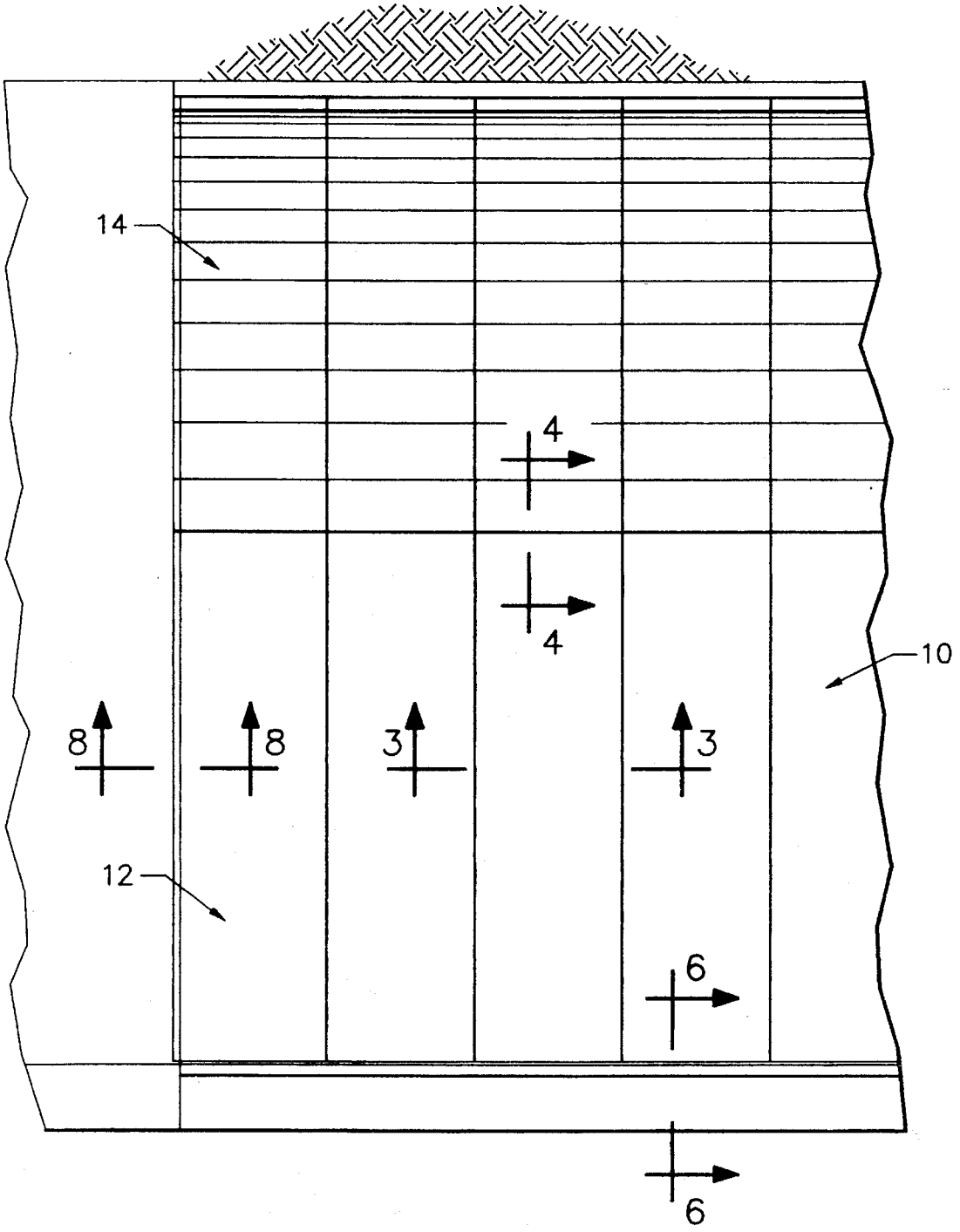
FIG. 2 is a longitudinal elevation view of the liner system taken along line 2—2 of FIG. 1.

The insulating tunnel liner system, generally designated 10 in FIG. 1, comprises a combination of prefabricated modular wall panels 12 and arch panels 14 to conform with tunnel dimensions and clearance requirements. The prefabricated liner panels 12 and 14 are joined in the tunnel, as shown in FIG. 2, to form a continuous insulating barrier between freezing temperatures in the tunnel and the wet face of the tunnel.

Figure 3:
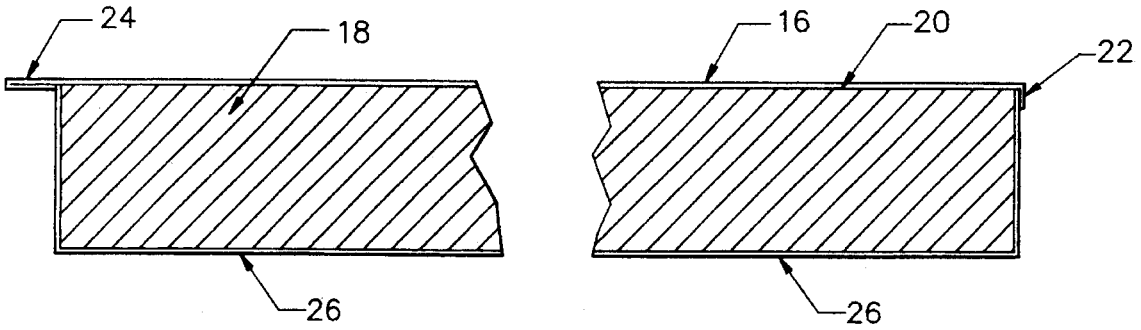
FIG. 3 is a typical sectional view of a liner panel taken along line 3—3 of FIG. 2.
Figure 4:
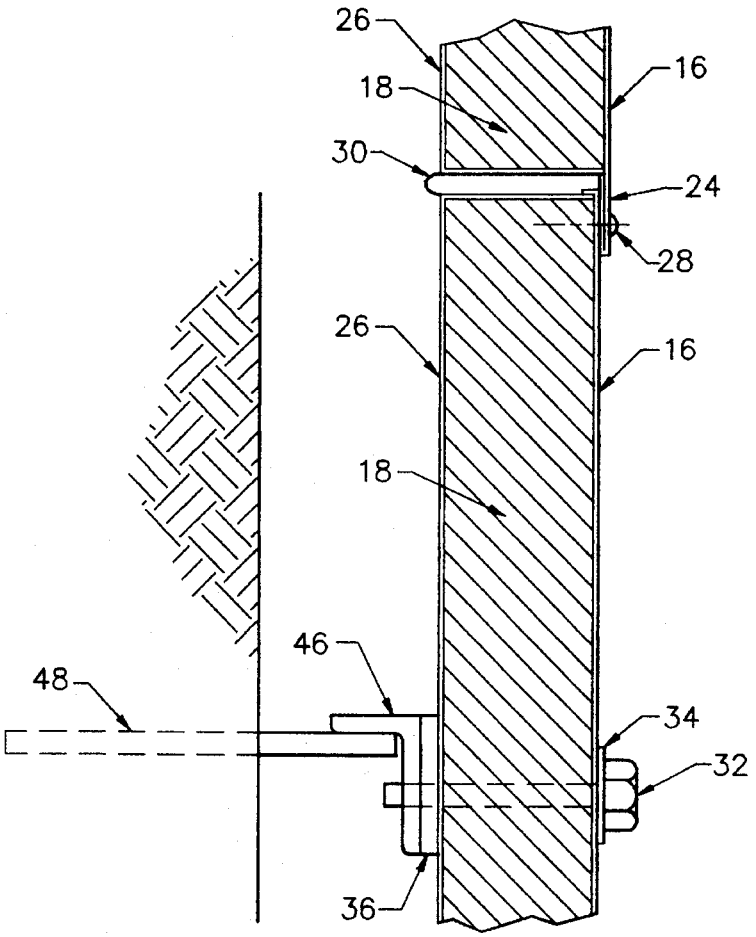
FIG. 4 is a sectional view of a typical panel joint and mounting taken along line 4—4 of FIG. 2.

As shown in FIG. 3, the individual liner panels 12 and 14 are comprised of a sheet metal or plastic skin 16, joined to a preformed insulating material 18 with a compatible adhesive film 20 of high bond strength. The skin 16 is formed to desired panel dimension with a lip 22 on two leading edges and an overhanging lap flange 24 on two trailing edges. Thus, as the panels are installed, as shown in FIG. 4, a lap joint is created, secured by sheetmetal screws 28.

The faces of the skins 16 are protected from corrosive elements by one or a combination of methods, including selection of appropriate metals or plastics, galvanizing or application of shop or field applied protective coatings.

The insulating material or core 18 may comprise any of a number of available insulating foams which meet the design criteria for a specific project related to closed cell content, density, compressive, shear and tensile strength and thermal conductivity. Examples of suitable materials include polyurethane, polystyrene and polypropelene although polyurethane is preferred due to flammability considerations.

Following adhesion of the insulating core 18 to the skin 16 the exposed faces of the insulating core 18 are coated with a water and vapor barrier film 26 which completely encloses and waterproofs the insulating core 16. The preferred coating is a sprayed-on, high-density elastomeric such as a two-component thermoplastic polyurethane. The ability of both the insulating core 18 and the enclosing film 26 to stretch allows the arch panels 14 to be fabricated and shipped in a flat configuration and formed to the tunnel arch during installation.

Figure 7:
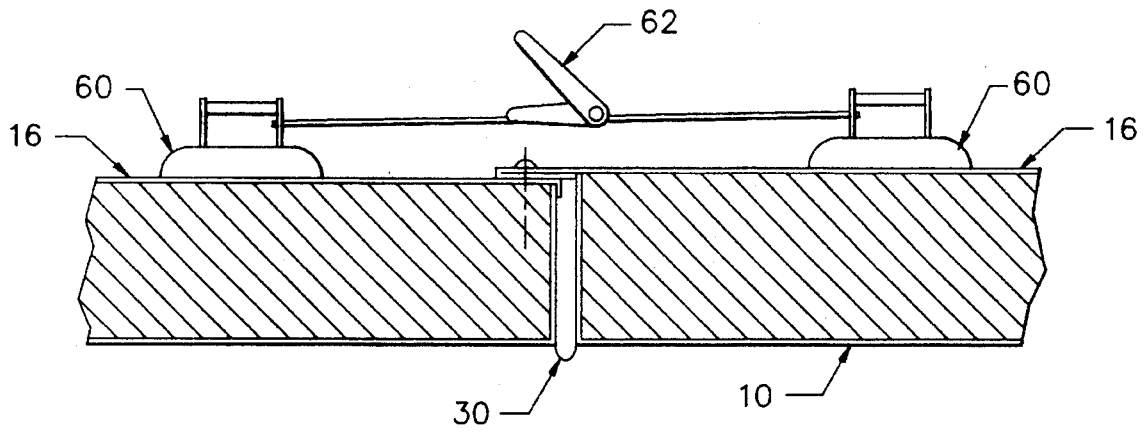
FIG. 7 is an elevation view of a rachet binder system to assist in proper placement and alignment of the liner panels.

The method of joining the panels into a continuous water and thermal barrier, as shown in FIG. 4, involves compressing of field-applied, non-hardening sealant 30 between the edges of adjacent panels 12 and 14 and securing the butt joint with sheet metal screws 28 through the lap joint flange 24. One method of bringing adjacent panel edges into proper compression and alignment is shown in FIG. 7 and consists of suction cups 60 attached to the joining panel skins 16 and connected with a rachet binder 62 to provide the force necessary to compress the joint sealant 30.

The preferred mounting of the liner system to irregular concrete tunnel walls, such as may be encountered in tunnels which have a shotcreted wall surface, is shown in FIG. 4. The mounting consists of through-panel nylon or similar low thermal-conductivity mounting bolts 32 and washers 34, secured to longitudinal angles or channels 46 which in turn are mounted to the concrete tunnel face with anchor bolts 48. A low-durometer spacer 36 is adhered to the mounting angle 46 at the point of panel penetration to eliminate trapped water, seal against water entry into the panel foam 18 and compensate for minor misalignment of the mounting angle 46.

Figure 5:
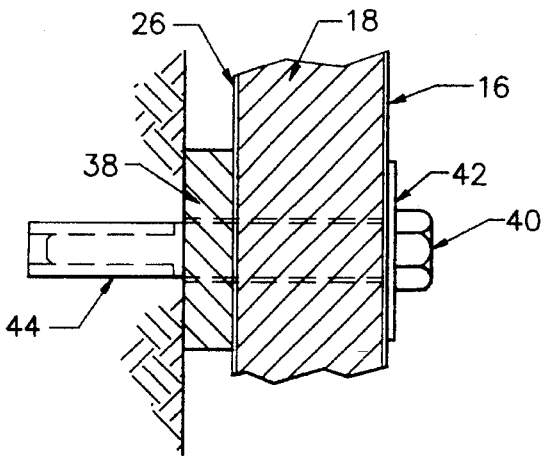
FIG. 5 is a section of an alternate panel mounting method to FIG. 4 for application on smooth tunnel walls.

In those instances where the tunnel walls have been formed and poured to reasonable tolerances, the support framing system defined above can be replaced by a low-durometer disc 38 as shown in FIG. 5. The disc 38 is attached to the waterproof film 26 at through-bolt 40 penetration points, such disc 38 to serve as a spacer between the panel system 10 and the tunnel face, and to serve as an equalizer to accomodate minor irregularities of the tunnel face. In such a case, the through-bolt 40 is attached directly to the tunnel wall by means of wedge anchor 44 or similar anchoring method.

Figure 6:
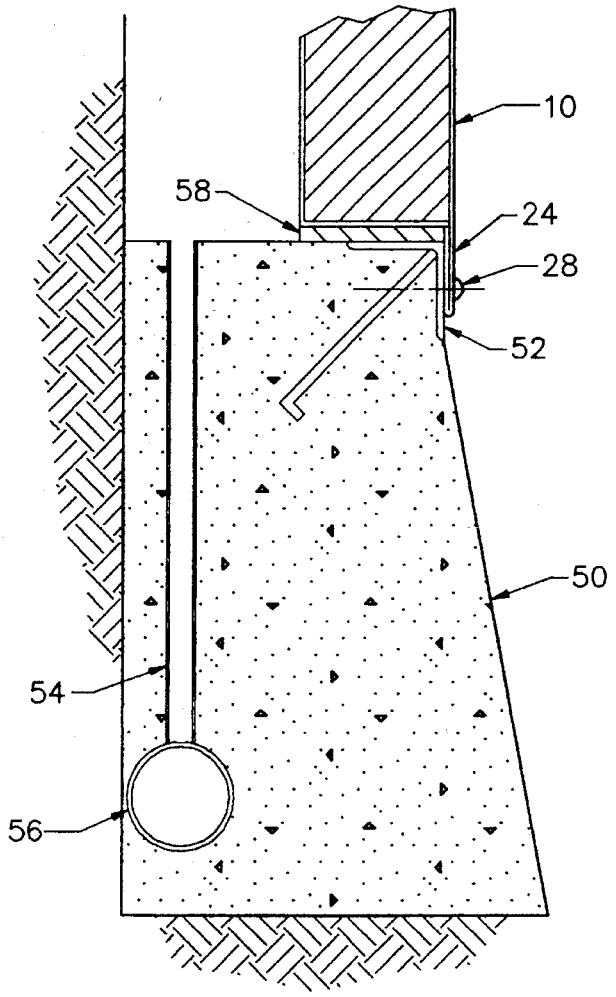
FIG. 6 is a typical sectional view of the panel footing taken along line 6—6 of FIG. 2.

A footing 50 for the panel system, as shown in FIG. 6, consists of a field formed and poured mixture of chemically-hardening binder and insulating aggregate to form a structurally sound, insulating base. A drainage system 54 and 56 is incorporated in the base to remove water from the annular space between the panel system 10 and the tunnel walls. A metal corner protector 52 is provided which also serves to secure the panel lap joint flange 24 by means of sheetmetal screws 28. A continuous, low-durometer pad 58 is also provided to seal the base of the panel system 10 against water leakage.

Figure 8:
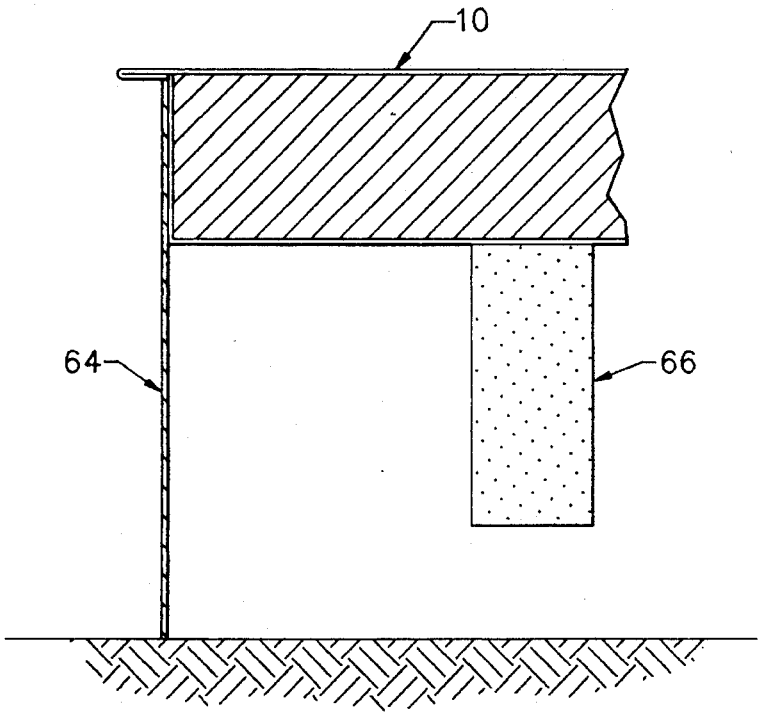
FIG. 8 is a sectional view of a pressure relief system taken along line 8—8 of FIG. 2 and located at each end of the liner installation.

A pressure-relief flap 64, as shown in FIG. 8, is adhered to the end rings of each section of the insulated tunnel as a means of equalizing the piston-effect pressures at the front and back of the insulating liner system 10. Piston-effect pressures and vacuums are created by traffic passing through a restricted tunnel space and must be compensated by either strengthening the panel system, adding a large number of panel supports or equalizing the pressures on both sides of the insulating panel system 10.

The latter alternative is accomplished herein by attaching flexible flaps 64, such as thin neoprene, to the end rings of each tunnel section to be insulated to serve as an end closure between the panel system 10 and the tunnel wall. An insulating ring 66 adhered to the back face 26 of the panel system 10 serves to minimize unwanted radiant thermal transfer while still allowing equalizing air flow.

As the train approaches the insulated section of the tunnel, the piston-effect pressure acts on the flap 64 to allow air flow in the annular space behind the panels, thus minimizing the pressure difference between the front and back of the panels. Once the flap returns to its neutral position it assumes a normal role of eliminating entry of cold air into the insulated annular space. Cold air which has entered during the passing of the train is warmed in a short period of time due to the large heat sink represented by the tunnel structure.

What is claimed is:

1. An insulating panel system adapted to wet concrete lined tunnels, comprising:

a plurality of modular interlocking liner panels each having an inner substantially load bearing flexible metal skin, an outer substantially non-load bearing flexible plastic skin and a preformed flexible insulating core adhered to both the inner and outer skins so that the panels can be shaped to conform to an arcuate tunnel shape;

mounting means for mounting the panels in a spaced relationship from the concrete lined tunnel so as to form an air gap between the plastic outer skin and the tunnel wall; and, end section insulating means for at least partially closing end sections formed by the liner panels to insulate air in the air gap from air outside of the tunnel whereby the concrete lining is insulated from the outside air and destructive freeze and thaw cycles are avoided.

2. The panel system of claim 1, wherein said liner system is mounted to the tunnel structure by means of low thermal-conductivity through-panel bolts connected, through low-durometer spacing and waterproofing pads, to continuous longitudinal elements which, in turn, are anchor-bolted to the tunnel wall.

3. The panel system of claim 2, for application on smooth tunnel walls, wherein a low-durometer pad is attached to said liner panels at the point of through-panel bolt penetration to serve as a spacer between said panel system and the tunnel wall.

4. The system of claim 3, wherein said through-panel bolt is attached directly to the tunnel wall by wedge anchors.

5. The system of claim 1, including a combination of suction cups, for application to adjacent panels, and a rachet binder for aligning the panels and providing compression of joint sealant placed between the liner panels.

6. The system of claim 1, including a footing for said liner system which is field-formed and poured with a mixture of chemically-hardening binder and insulating aggregate to form a structurally sound, insulating base wherein said footing is provided with drains to remove water from the air gap between said liner panels and the tunnel wall, a continuous low-durometer gasket to seal the base of said liner system against water leakage and a means for securing panel lap joint flanges to the base.

7. The panel system of claim 1, wherein the end section insulating means includes a selective mechanism for allowing air external to the tunnel to enter the air gap when vehicular traffic enters and exits the tunnel.

8. The panel system of claim 7, wherein the selective mechanism has flexible pressure relief flaps adhered to each insulated tunnel section and extending to a face of the tunnel wall.

9. The panel system of claim 8, wherein said pressure-relief flap is backed by an insulating ring in such a manner that radiant cold transfer is minimized without affecting equalizing air flow.

* * * * *